United States Patent [19]

Everton

[11] 4,141,548

[45] Feb. 27, 1979

[54] GAME APPARATUS FOR USE IN CONJUNCTION WITH THE VIEWING OF A SPECTATOR'S SPORT

[76] Inventor: Irving M. Everton, 1701 Brookcliff Dr., Greensboro, N.C.

[21] Appl. No.: 869,526

[22] Filed: Jan. 16, 1978

[51] Int. Cl.[2] ..... A63B 71/04; A63F 7/00

[52] U.S. Cl. ..... 273/1 E; 273/DIG. 28

[58] Field of Search ..... 35/9 R, 9 B, 48 R, 29 R, 35/9, 29, 48; 273/1 E, 1 ES, 55, 94, 85 G, DIG. 28, 1, 55, 85; 235/92 GA, 92; 340/323 R, 323

[56] References Cited

U.S. PATENT DOCUMENTS

| | | | |
|---|---|---|---|
| 2,780,461 | 2/1957 | Ryan | 273/94 |
| 3,124,674 | 3/1964 | Edwards et al. | 273/138 A |
| 3,231,276 | 1/1966 | Cooper | 273/94 |
| 3,416,242 | 12/1968 | Nisbet | 35/48 R |
| 3,427,732 | 2/1969 | Wopart | 35/48 R |
| 3,538,626 | 11/1970 | Frank | 34/48 R |
| 3,559,992 | 2/1971 | Kramer | 273/94 |
| 3,570,146 | 3/1971 | Golden | 35/48 R |
| 3,579,869 | 5/1971 | Hewitt | 35/48 R |
| 3,630,522 | 12/1971 | Bear | 273/94 |
| 3,699,671 | 10/1972 | Desmond | 35/48 R |
| 3,728,480 | 4/1973 | Baer | 273/85 G X |
| 3,786,234 | 1/1974 | Trent et al. | 273/138 A X |
| 3,810,627 | 5/1974 | Levy | 273/138 A |
| 3,868,112 | 2/1975 | Avera | 273/94 |
| 3,871,652 | 3/1975 | Schreier | 273/94 R |
| 3,909,002 | 9/1975 | Levy | 273/138 A |
| 3,995,863 | 12/1976 | Cumming | 273/94 R |

FOREIGN PATENT DOCUMENTS

| | | | |
|---|---|---|---|
| 747794 | 12/1966 | Canada | 273/94 |

*Primary Examiner*—Vance Y. Hum

[57] ABSTRACT

A spectator participation game apparatus for use in conjunction with the observance of a program or sporting event such as a football game in which one or more observers on separate game apparatuses try to predict the type of "play" or occurrence which will next ensue, as well as predicting separately the outcome or results of the succeeding play. The game apparatus includes a selector panel for each participant on which are located a plurality of play selection switches, a plurality of outcome switches, and a score indicator; a control unit connected to the selector panels for control thereof, and an electrical logic circuit for changing the scoring indicators responsive to the type of play actually occurring and the results thereof.

14 Claims, 9 Drawing Figures

| IPA | IPB | OPA | OPB |
|---|---|---|---|
| "0" | "1" | "1" | "0" |
| "1" | "0" | "0" | "1" |

GAME APPARATUS FOR USE IN CONJUNCTION WITH THE VIEWING OF A SPECTATOR'S SPORT

BACKGROUND OF THE INVENTION

With the advent and commercialization of integrated circuit chips and speed of calculations resulting thereof, there has resulted a plethora of new games whereby players, using electronics, may match wits or skills with each other. Such games generally involve the playing of some type of contest between players and involving electronically controlled movement on a playing board or screen itself. In any event, the playing of the game actually occurs on the playing board or screen itself which utilizes internally the integrated circuit chips during the proceedings thereof.

Also in recent years television broadcasting has created a popularity for sports viewing which has continually grown. Especially such games as football which involve a plurality of consecutively occurring events or "plays" each of which include a selection portion in which the type of play is selected and the execution portion or "outcome".

However, to the knowledge of the applicant there has been no game developed utilizing the new concepts of electronic games which is played in conjunction with the viewing of an actual sporting event, ass all of the known games involve simulated or self-contained games as a part of the apparatus itself. The viewing of a spectator sport can be made much more enjoyable if the spctators can institute some type of competitive relationship between themselves which involves their predictions of how real players will actually perform.

SUMMARY OF THE PRESENT INVENTION

A parlor-type game played in conjunction with the observance of some type of sporting event such as football, in person or on television or even while listening to the radio, in which contestants select certain aspects of a subsequent event and then are scored responsive to the accuracy of their predictions. Each player is provided with a selection apparatus having a first set of switches. In playing the game each participant selects one of the first set of switches corresponding to his prediction of the play which will next occur. Then a participant selects, if he desires, from a second set of switches the predicted outcome of such play. Finally, each player's apparatus includes a score display which keeps a running total of the score of the particular player operating the apparatus.

In addition, there is a control apparatus which, first of all, locks in the selection switches once they are made, then activates the scoring indicators on each of the player selection apparatuses to reflect the proper change in score determined by the successfulness of the participants' predictions as to the type of play and success thereof.

Preferably the control unit is electronically connected to the individual selector panels either by hard wiring, printed circuitry, wireless transmission or through a combination of the above methods of connection. In an extreme situation, however, the units might be mechanically connected so that the control unit mchanically locks in selections on the selector panels, then activates the scoring apparatus of each panel after the end of a play responsive to the outcome thereof.

In the preferred embodiment an electronic logic circuit receives input from each of the selector units and the control unit, and it in turn analyzes predictions and adjusts the score on the individual selector units responsive to the correctness of the predictions.

In playing the electronic game, for example, in conjunction with the observance of a football game, the selector panels include a plurality of prediction switches designated "pass", "run", "punt", and "field goal". In addition, in the second set of switches on each selector panel there are switches designated "gain", "loss", and "zero". As a player is observing a football game and before any play of the game, the player predicts the type of play which will next ensue by activating a switch in a first set of switches, then predicts the outcome of the play ensuing by activating a switch of the second set of switches provided. Once the predictions are made and prior to the time the play is run, a controller with the control unit locks in the predictions on the selector panels so that they cannot be changed. After the play is over, the controller punches in the actual executed play on the control panel as well as the oucome thereof, which information is electrically relayed to the selector panels and, responsive thereto, the scoring means on each panel is adjusted accordingly.

It is therefore an object of the present invention to provide a unique type of spectator participation game for use in conjunction with the observance of certain types of events.

It is another object of the present invention to provide a spectator participation game for use in conjunction with the watching of a football game wherein one or more observers on separate game apparatuses try to predict the type of play to occur on the next event as well as predicting the outcome of the event as far as gain or loss is concerned.

It is another object of the present invention to provide an electronic game apparatus for matching the wits of one or more observers with the actual participants of a sporting event such as football.

Other objects and a fuller understanding of the invention will become apparent from the reading of the following detailed description of a preferred embodiment in conjunction with the following drawings in which:

FIG. 1 is a schematic representation of two selector panels and a control panel set up for the use of the game in conjunction with the watching of football;

FIGS. 2*a* through 2*g* is an electrical schematic of the embodiment illustrated in FIG. 1; and FIG. 3 is an electrical schematic of a typical latch circuit used throughout the schematic of FIG. 2.

DETAILED DESCRIPTION OF A PREFERRED EMBODIMENT

Figure 1:
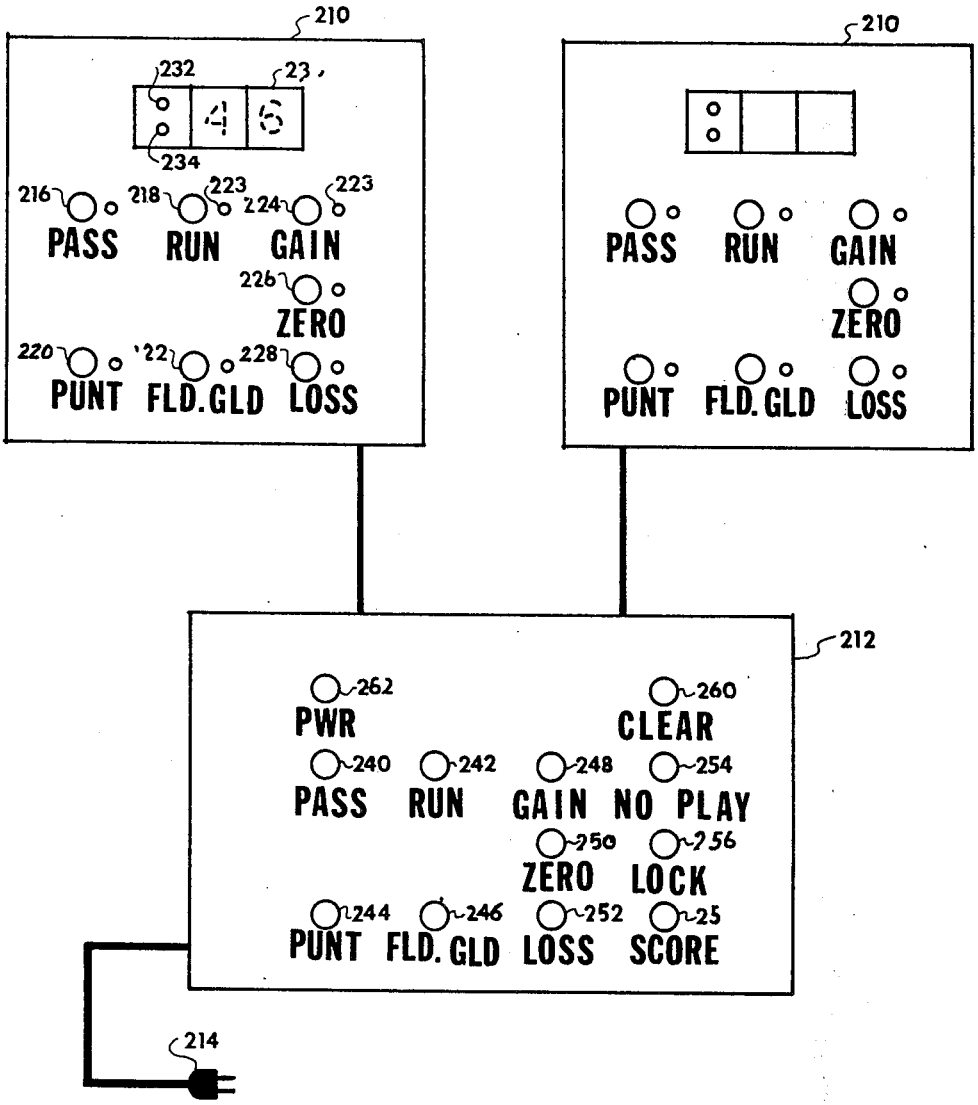
Figure 2A:
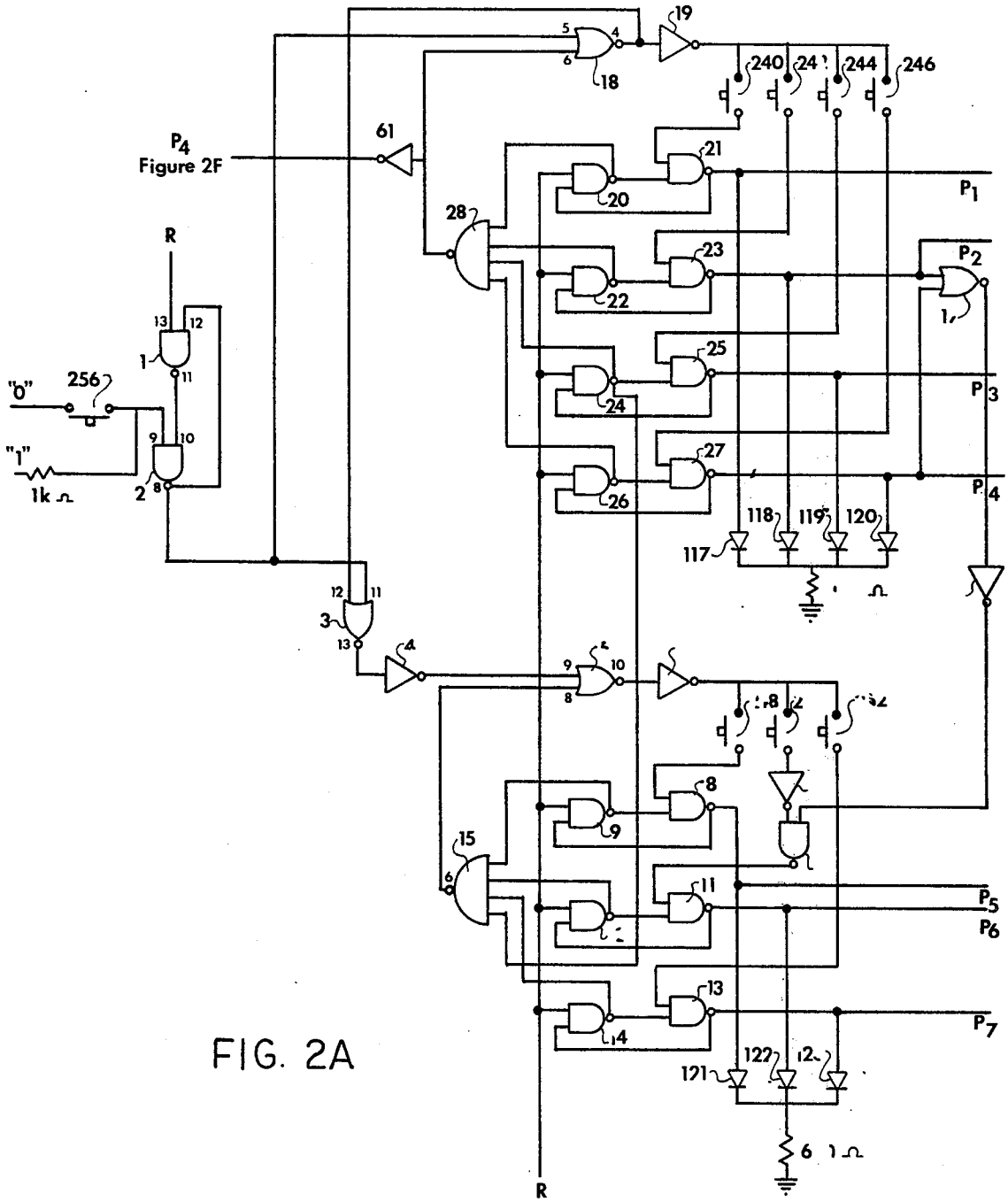
Figure 2B:
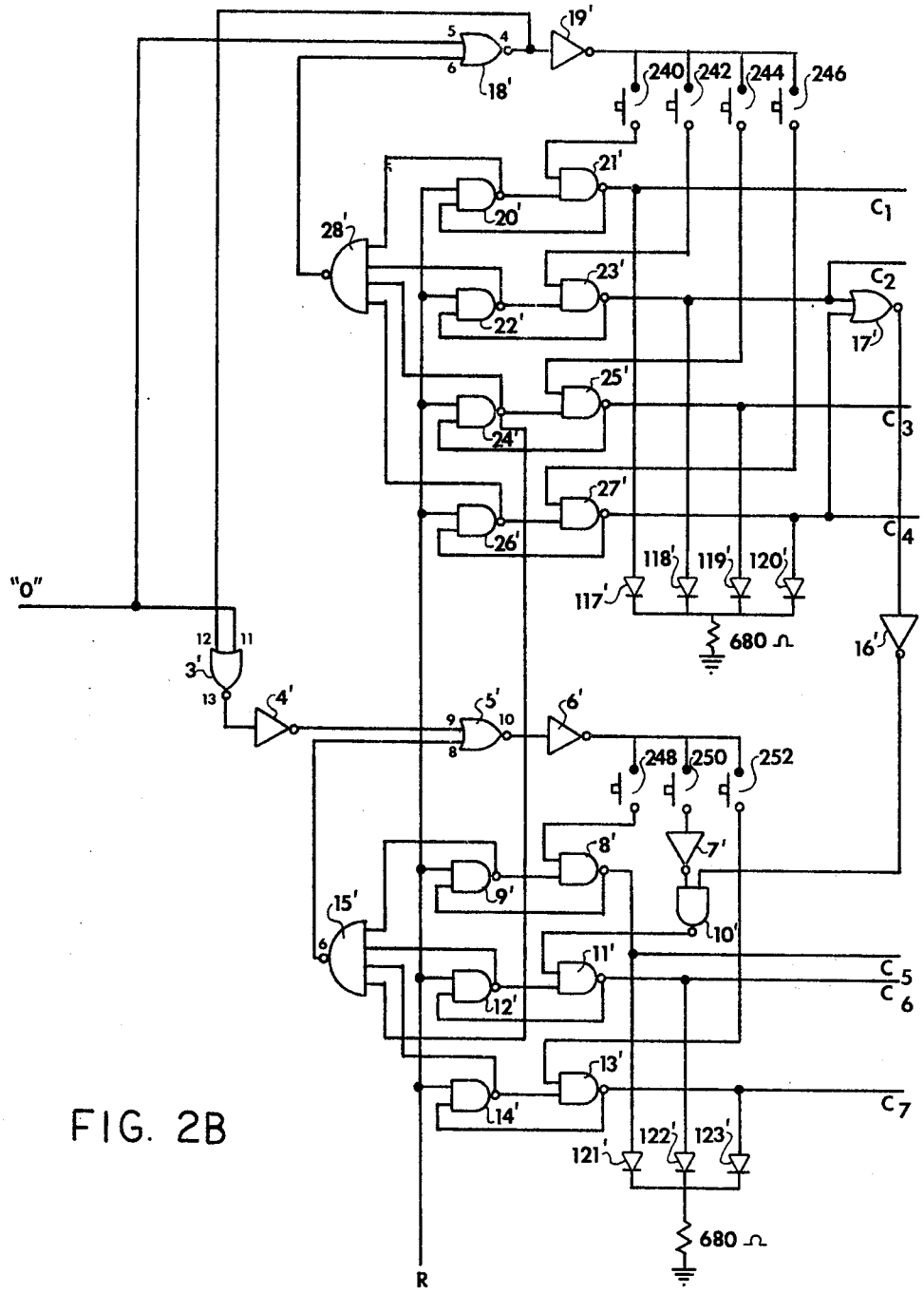
Figure 2C:
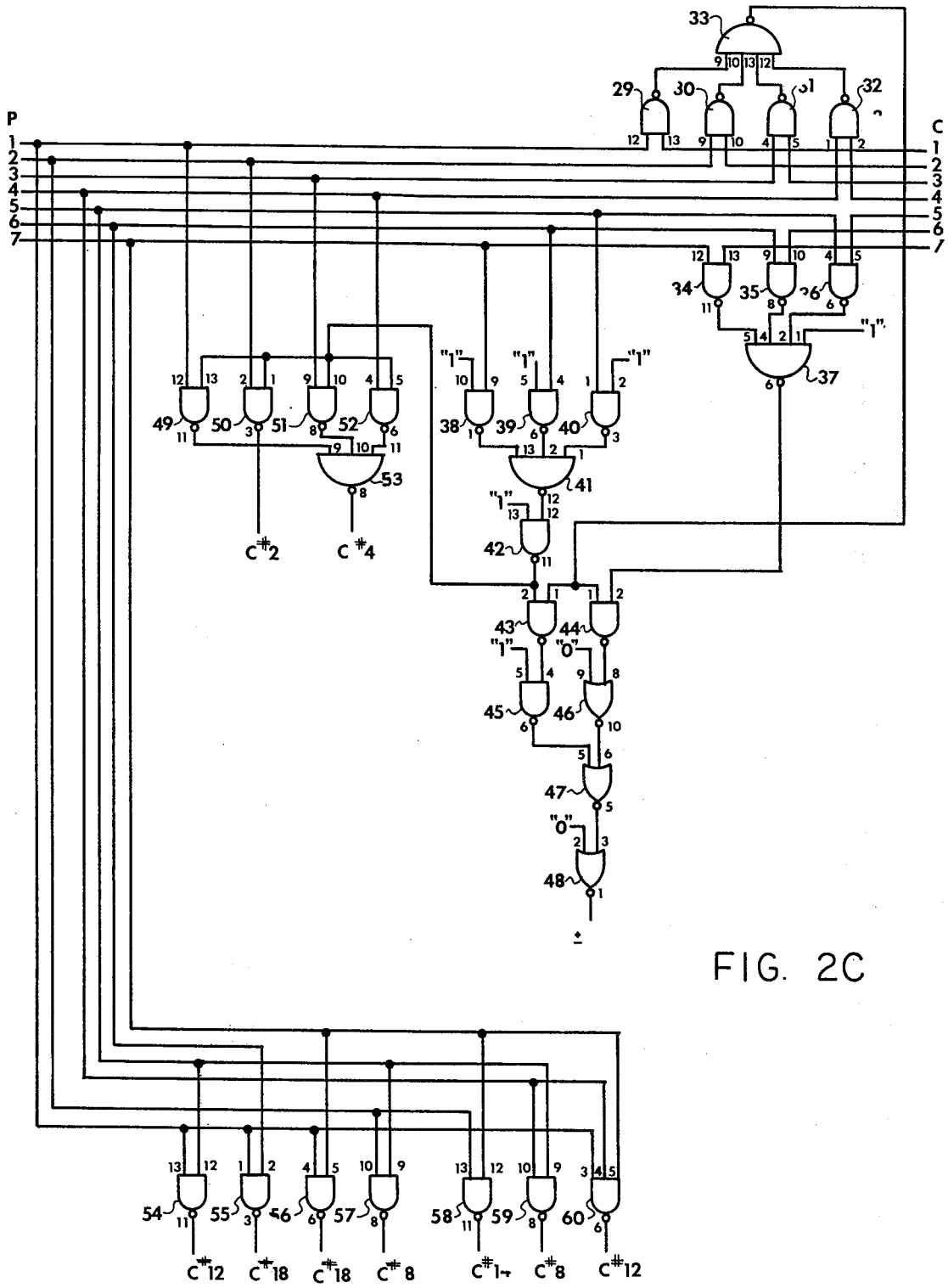
Figure 2D:
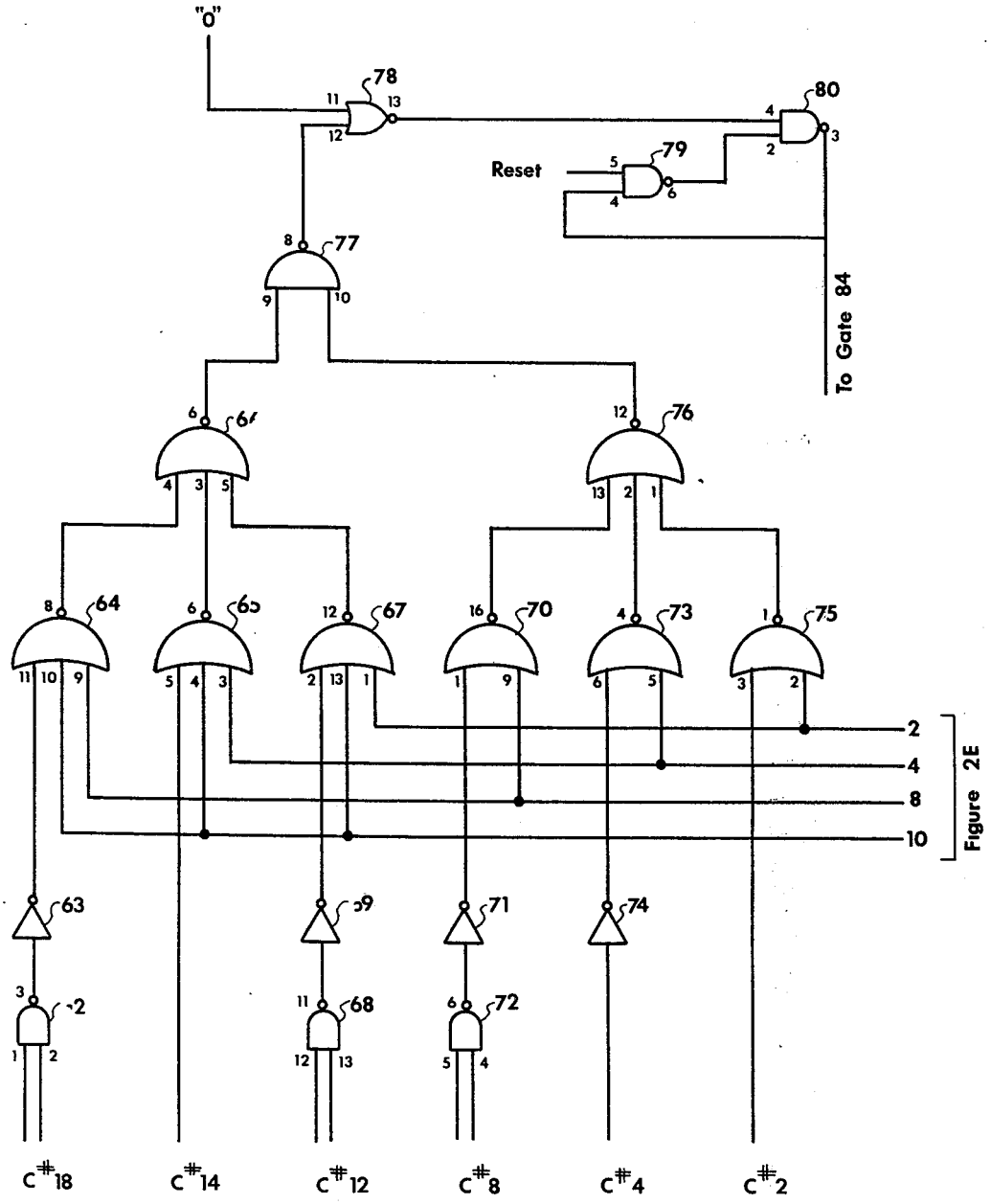
Figure 2E:
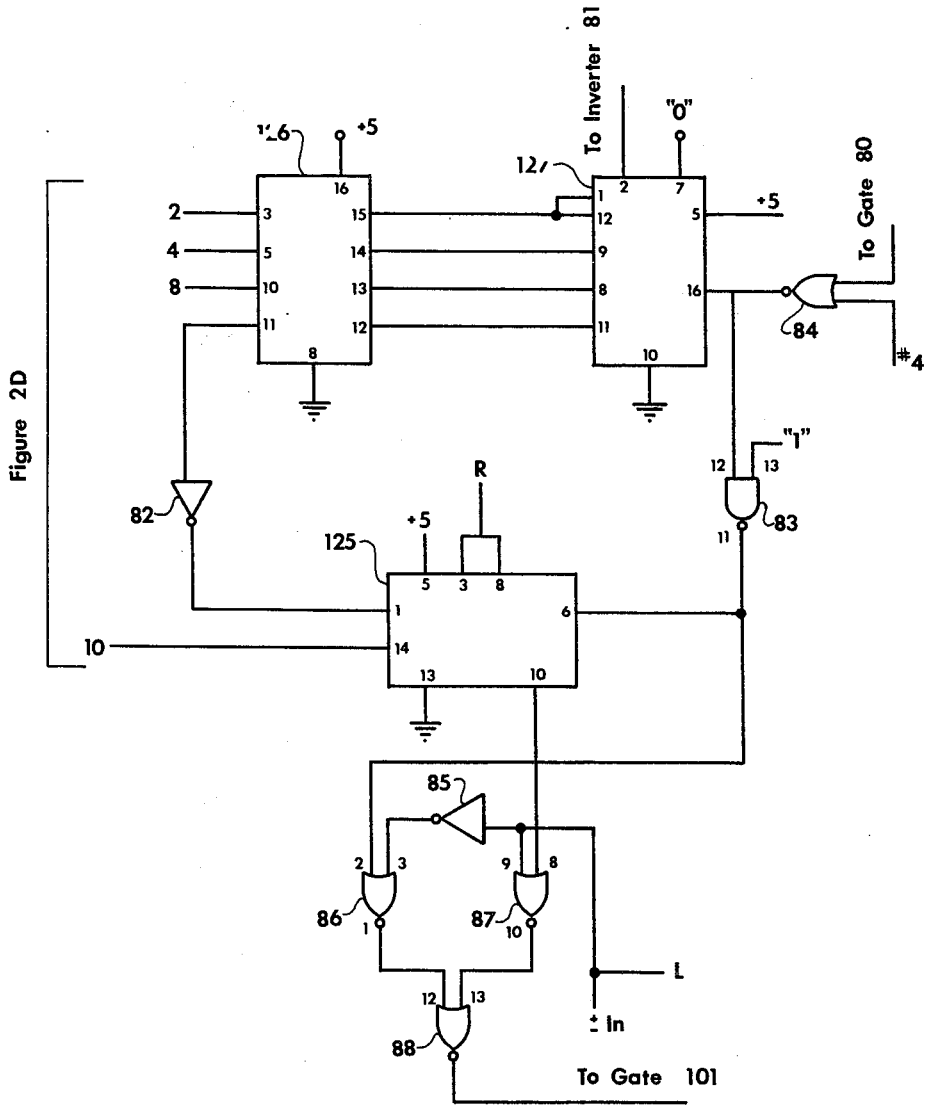
Figure 2F:
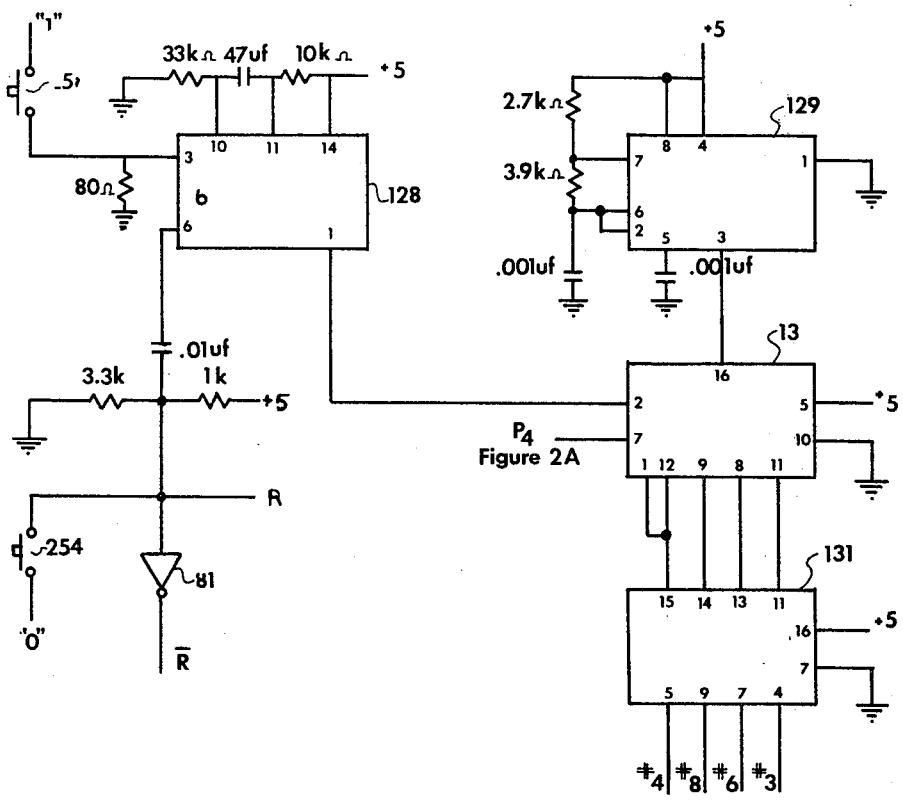

The following description should be considered in conjunction with FIGS. 1 and 2 which, in accordance with the invention, illustrate one embodiment of an amusement device used in conjunction with the watching of a football game. As described hereinabove the invention may be adapted for use with the viewing of other type of events or programs also; however, for purposes of description it will be described hereinbelow in use with the viewing of a football game.

Turning now to FIG. 1 there is illustrated a board set up for two players and a controller, wherein each player has access to one of the selector panels 210,210' . . . 210x, each of which is connected by wire, wireless, or other conventional remote connecting means to a single control panel 212. Control panel 212 preferably is plugged into or contains the power source for the entire apparatus. The power sorce may be connected into a conventional AC plug 214, or may be battery operated. Selector panels 210,210' . . . 210x are identical, therefore only a description of panel 210 will ensue.

First of all, there is a first set of switches made up of four selector buttons 216, 218, 220, 222, and which include thereunder the designations "pass", "run", "punt", or "field goal" respectively. Adjacent the aforementioned push button switches is a second set of switches comprising three other push button switches 224, 226, 228, each of which includes in association therewith the designations "gain", "zero", or "loss" respectively. Finally, the selector panel includes a scoring display means 230, which is preferably a plurality of light emitting diodes (LEDs) arranged in side-by-side relation to illustrate a score of multiple digits. In addition, immediately in front of the scoring means 230 may be one or more indicator lamps or diodes 232, 234 which show up merely as a dot. One of these dots 234 indicates that the score is negative as when a person has points taken off from a zero reference point. The other dot 232 may be used to indicate that the score has gone over the 99 indication and is actually 100 plus whatever appears on the scoring display means 230. Each push button switch includes an associated indicator lamp 223 which is indicative that the corresponding switch(s) is locked in the circuit.

The control panel 212 is fairly similar to selector panel 210 in that it also includes a result signal switch means in the form of a plurality of push button switches 240, 242, 244, 246, 248, 250, and 252, each with the designations "pass", "run", "punt", "field goal", "gain", "zero", and "loss" respectively. In addition there are additional switches 254, 256, 258, 260, 262 designated "no play", "lock", "score", "clear", and "power" respectively. Also as is evident there is no necessity for any scoring display means on the control panel 212. An electrical circuit means associated with each of the selector panels and the control panel (FIG. 2) provides for the comparing of prediction data from the selector panels 210 and outcome data from control panel 212. The score display 230 is adjusted responsive to the results from such comparison. There will now follow an explanation of the electrical arrangement which operates the above mentiond selector panels and control panel.

All electrical power for the system is preferably furnished through the controller board 212, although other provisions for power are possible. Game play cannot be started until the controller has activated the proper switches on his board to establish the starting state for all boards. Once the controller determines that all players' boards are connected he turns on the power switch and activates the CLEAR button 260 to reset all playing board score displays to 00. The SCORE button 258 is wired into the circuit to reset all circuit electrical components to the proper state for receiving new pulses or signals. Once the CLEAR and SCORE buttons 260, 258 have been activated all players should be advised that their boards are ready for play. The CLEAR button must not be activated again during the game since doing so will erase all players' scores.

PLAY SEQUENCE

The boards are now ready to begin play. Each player may now make his prediction for the first play by selecting any of the available sequences described under rules of the game. Selections may consist of any single push button switch from the type of play group or set numbered 216, 218, 220, or 222 or a two switch combination consisting of one switch selected from the first set numbered 216, 218, 220, 222 and one switch selected from the second set numbered 224, 226, and 228. As described hereinabove the purpose of the player's selection is to predict a particular type of occurrence or play that is about to occur and, with the second switch to also predict the outcome or results of the occurrence when it does occur. The purpose on the control board 212 of result signal switches 240, 242, 244, 246, 248, 250, 252 is to enter into the circuit, at a time after the remote event has occurred and produced a result, the actual event and result that did occur. If these items, when entered on the control board, match correctly with an individual player's previous predictions, his individual player selector board 210 scoring display 230 will be electronically changed to produce a pre-set addition to the player's score when the "score" switch 258 on the control board 212 is activated. Should the entries on the control board 212 be different from the pre-selected entries on the individual player board(s) 210 then the player board will be electronically changed to produe a pre-set reduction in the player's score value upon activation of the controller's "score" switch 258.

SWITCH FUNCTIONS

The basic function of switches 254, 256, 258, 260, 262 on the controller board is as follows:

Switch 262: This is the POWER switch. It has an "On" and "Off" position and either applies or removes power from the entire system.

Switch 260: This is the CLEAR switch. The purpose of this push button switch is to drive all player score values to zero. This switch is activated only once at the beginning of each game. Activation of the CLEAR button at any time during the game will result in removing all players' scores.

Switch 256: This is the LOCK switch. The purpose of this switch is to lock all player boards in the circuit at particular selected times during the game. When the LOCK circuit is activated the player boards are locked into whatever configuration they are in at the time of the LOCK switch activation. No further entries can be made on the individual player boards until the LOCK condition has been released by the controller. This arrangement precludes the possibility of a player making his "prediction" after the actual event has occurred and prior to the entry of the event into the controller's board.

Swich 254: This is the NO PLAY switch. As noted previously the entries on the player board are made prior to the occurrence of the actual event and its results being noted. Entries on the control board are made after the event has occurred and its results have been observed. In actual play there will be occasions when the player board entries have been made and the player boards have been LOCKED by the controller but for various reasons the actual event does not occur as planned (time outs, end of half or game, etc.). When this happens it is desirable to allow the player to change his selection without incurring a change in score. The NO PLAY switch is incorporated to facilitate this "change of prediction" feature. After the controller has activated the LOCK switch he may, if conditions warrant, activate the NO PLAY button and thereby release all player boards from the LOCKED condition. Activation of this switch will remove all selections previously made by the player and leave each player board in a ready-to-begin-play condition. No change in score will occur.

Push Button 258: This is the SCORE switch and, in addition to being used at the outset of a game to reset all selector board components to the proper state, is a two purpose button which is activated by the controller after he has made the proper entries on buttons 1 through 7 in accordance with the actual type of event that occurred and its results. When this button is pressed it will:

(a) activate circuits in each player board for a fixed time interval to allow the proper score value to be processed through the player board circuit and either added or deducted to the individual players score display; and (b) remove all previous selections that were made on the individual player boards and reset all player boards' circuitry to a starting position for the next play prediction entry(s).

Electrical Operation

Figure 3:
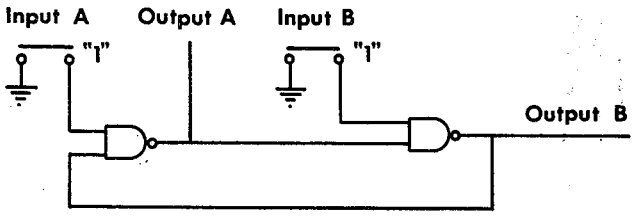
Figure 2G:
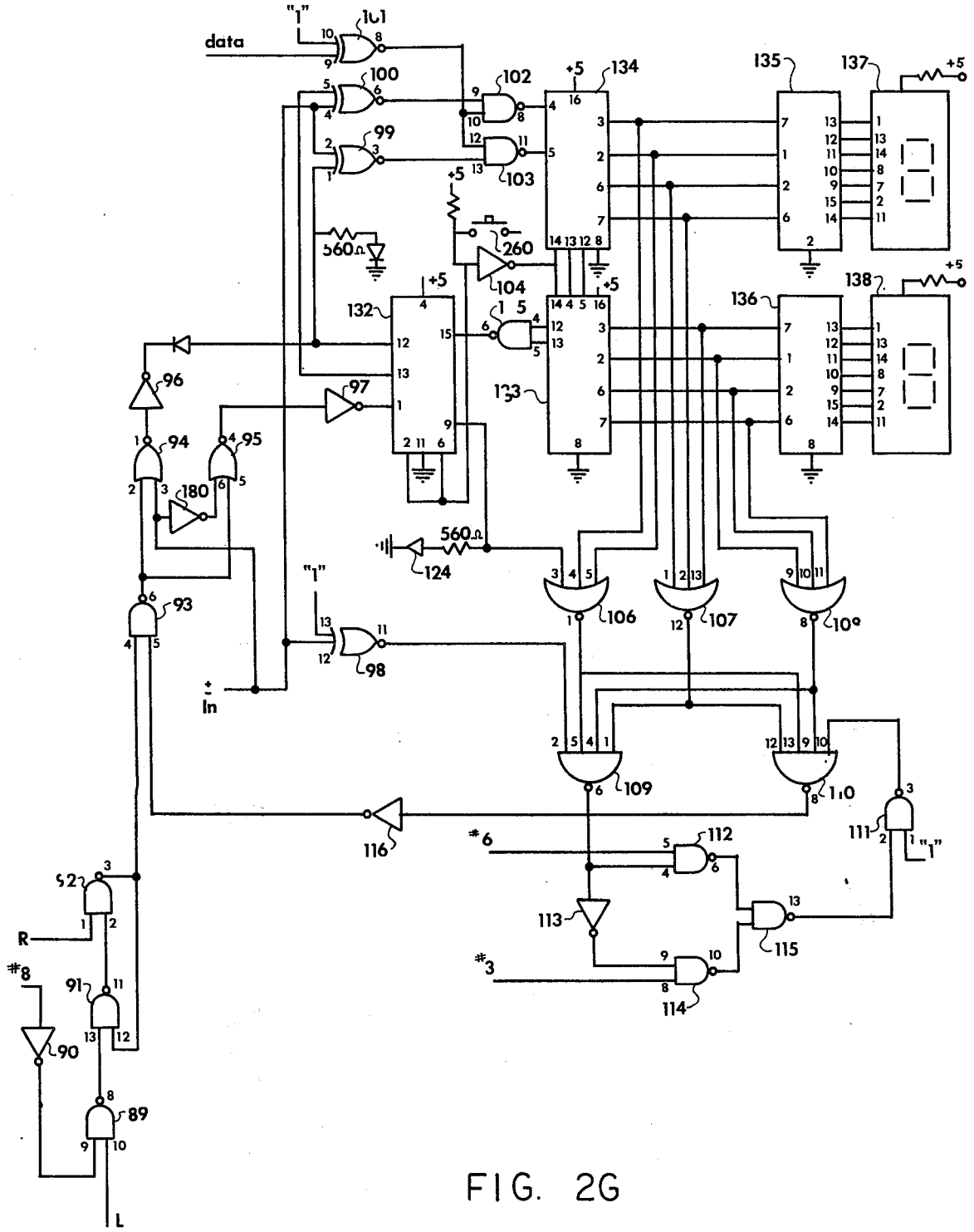

Before launching into a description of tracing a pulse through the electrical schematic of FIGS. *2a-g*, it should be pointed out that FIG. 3 illustrates a "latch circuit" that is used repeatedly throughout. This is a rather conventional latch arrangement utilizing a pair of tandemly wired NAND gates which perform as illustrated in the table shown in FIG. 3. As input B is grounded, as by closing of a push button switch, output B goes positive; however, the circuit is latched so that no other signal can be put in or changed until the circuit is reset. In other words the inputs to the circuit are locked.

After the CLEAR push button switch 260 and SCORE button 258 have been activated all boards are set to begin play with the scoring readout at "0", electrical action in the system is as follows. For this example the selection made by the player will be button 216 or "PASS". When button 216 is depressed the above described "latch circuit" controlled by button 216 (gates 20,21) locks into position giving a "1" output on the right hand output from gate 21 and a "zero" output on the top output from gate 20 . This in turn lights the indicator lamp or LED 118 adjacent the "PASS" button, changes the state of the lower input pin 12 on gate 20, changes the state of input pin 12 on gate 49, input pin 13 of gate 54, input pin 1 of gate 55, and input pin 1 of gate 56. The state change of the top output of LATCH #1 produces a state change at the output pins of gates 28, 61, 18, 19, 3, 4, 5, and 6. The change in output state of gate 6 establishes a condition which will allow the player to now make a selection on push buttons 224, 226, or 228. For this particular example no entries will be made on these buttons. Since buttons 224, 226, 228 have not been activated the P3 signal remains unchanged at its initiation point at the output of gate 42. This produces an unchanged state at pin 13 of gate 49 which, when coupled with the changed state of pin 12 at gate 49 enables this gate and changes the output at pin 11 of gate 49. This change in output at gate 49 produces a change in state of the output at gate 53 which produces changes at the output of gate 74 and at the input pin 6 on gate 73. This condition enables gate 73 to receive and transmit through the gate the counter pulse signals which will eventually be initiated from pin 5 on driver 126 if the prediction is successful. The aforementioned portion of the circuit will be referred to as the "prediction data transmitting portion". At this stage in the sequence of play, however, no signal is yet available from pin 5 on driver 126. This signal will not begin until the controller has activated the score switch on the controller board and, assuming the prediction was correct, a pulse from pin 5 of driver 126 will emanate to pass through gate 73.

At this point in the sequence of play the actual event occurrence is awaited. Prior to the occurrence of the event the controller must press the lock switch 256 on the control board 212. This lock circuit or means is composed of gates 1 and 2. When lock switch 256 is depressed the output causes a subsequent change in the output of gates 18, 19, 3, 4, 5, and 6. Changing the output of gate 19 and 6 produces a "1" state at each of these points and with this change effectively blocks any additonal entries on any player board. Once the LOCK is activated and all player boards are locked in position we are then awaiting the occurrence and result of the anticipated event.

After the event has occurred and its results have been observed the controller makes the appropriate entries on the controller board. The next ensuing description will then be referred to as the "outcome data transmitting portion". For example it is assumed that the event that occurred was the event described by the nomenclature of switch 216. This means that the player has correctly predicted a pass in the football game. In this instance he did not attempt to make a prediction regarding the result (gain, loss, or zero yardage). However, we will assume that the result of this particular event matches the description shown on switch 224 (gain). In this manner the circuit will be followed through after the controller has made his appropriate controller entries.

The controller now presses button 240 and button 248 of the control board 212. When button 240 on the controller board 212 is pressed the "latch circuit" controlled by button 240 (NAND gates 20' and 21') on this board changes position giving a "1" state on the end output of the latch circuit (output B) amd a "0" state on the top output (output A). This change of state from the end output of the latch circuit changes the state of pin 13 at gate 29. Gates 29-37 are considered to be the "data comparing portion" of the circuit where the predictions are judged by the circuit and a correct or incorrect signal passed on. We now have a condition where the selection made by the player and that made by the controller has matched and changed the states of both pins 12 and 13 of gate 29. This combined change of state from pins 12 and 13 has enabled gate 29 to make a change in state to gate 29 output, gate 33 output, gate 43 output, and the #1 input leg of gate 44, the output of gates 45, 47, and 48. The output state of gate 48 at this time is "1" or a plus condition. This plus condition signals to the circuit that the score which was selected when the player board button 216 was depressed is to be a positive score showing a win. The "1" signal from the output of gate 48 closes gate 87, changes the output signal of inverter 85, opens gate 86, creating a path for the data signal through gate 88 which is continuously open. The data signal is now available to go into the counter circuit of the system.

Moving forward to the calculating portion of the circuit where counting occurs, at flip-flop 132 the condition of pin 12 is "0" and the condition of pin 13 is "1" in accordance with the position of the flip-flop which was established when the CLEAR button was depressed. These signals supply input to pin 5 of gate 100 and pin 1 of gate 99. Moving back to the output signal of gate 48 and following the circuitry this signal now provides an input signal of "1" to pin 4 of gate 100 and to pin 2 of gate 99. Under this established condition the output of gate 100 is "0" which closes gate 102. The output of gate 99 is "1" which opens gate 103 making it ready to receive the data input and deliver it to counter 134 of the counter circuit. This output of data from gate 103 will be entered on counter 134 through pin 5 producing an upcount in the players score. At this point the circuit is now established to receive count data. No count data has, at this time, been initiated.

At this stage the following sequences have occurred:

(a) a player has made his prediction of the event that will occur and if applicable the result of the event;

(b) the controller has locked the player board circuits;

(c) the controller has entered on the control board the results of the event that have now occurred and the results of the event.

The board circuit is now ready for the score to begin. This is accomplished by presssing the SCORE button 258 on the controller's board 212. This button serves as an initiation switch for pulse generator 128, which will generate a pulse of preset time length through pin 1 upon release of the score button. The pulse length in this particular instance is approximately 10 milliseconds. This pulse signal enters counter 130 through pin 2 which establishes the counter in an open condition for receipt of pulses from the system clock.

Timer 129 serves as a continuously running clock for the circuit. Pulses are issued from this unit by pin 3 into counter 130 by pin 16. Counter 130 will receive and transmit clock pulses only during the length of the pulse that was initiated from pulse generator 128. The pulse length in this case is adequate for counter 130 to receive and transmit approximately 400 pulses. Counter 130 drives driver 131 which develops the data output signal. The data signal selected is applied by pin 5 and is data signal #4 of the circuit.

Note at this point that the outputs of pins 4, 7 and 9 of driver 131 are being ignored. This portion of the circuit and a number of other areas in the circuit will be held for inspection at the completion of this description. The reason for this is that these outputs and that particular portion of the entire circuit are devoted strictly to obtaining a desired scoring sequence as required for this application. The continuing pulse signal from pin 5 of driver 131 passes through gate 84. This gate was opened through pin 9 thereof when the score button was originally pressed and the reset feature was activated. The pulse passing through gate 84 feeds gate 83 and counter 127. The feed to IC 127 is through pin 16 which, in turn, drives IC 126. The output of pin 5 of driver 126 feeds the pin 5 input of gate 73. When this signal drops to a "0" level gate 73 changes output which subsequently changes the output of gates 76, 77, 78, 80, 84 and gate 79. This change of signal to input 8 of gate 84 closes this gate so that no other pulses from driver 131 can pass the gate.

Change in state of the output of gate 80 also feeds pin 4 of input of gate 79 which latches the output of gate 80. This latch circuit is formed by gates 79 and 80.

The data pulse emitted at pin 5 of driver 131 travels through gates 84, 83, 86, 88, 101, and 103 to enter at pin 5 for an upcount on up/down counter 134 of the counter portion of the circuit. It should be noted here that the data which arrives at pin 5 of drive 131 is the same data that was fed and described through counter 127 and driver 126 and was used to close gate 84 after the proper number of count pulses had entered the counter circuit.

Reverting to pulse generator 128, there was initially described the pulse that was initiated in pin 1 when the score button was released. At the same time that this negative pulse is transmitted through pin 1, a simultaneous and identical length positive going pulse is transmitted through pin 6. The falling edge of this pulse produces a spike type reset signal which resets all latch circuits in the systems and all IC chips which require resetting with the exception of IC chips 132, 134 and 133. This action concludes all sequences required for one particular play and the board is ready for receipt of input signals from the player board initiating the next play.

In the event just described the selection made by the player on his selector board 210 matched with the entry that was made on the controller board 212. This occurs when the player selection is correct and this type of occurrence produces a positive score for the player. The opposite of this would be when the player failed to properly predict the event and the entry on the player board did not match at gate 29 with the entry made on the controller board. Under this circumstance the output of gates 33 and 48 will remain unchanged. The normal output of gate 48 is "0" which produces a negative score for the player. The effect of this signal can be observed at gate 87 which is now open and at gate 86 which now is closed. The pulse sequences through the number counter circuit remain identical to those that were used for positive score until the pulse signal passes through gate 83. At this point the pulse signal now finds gate 86 closed and goes through pin 6 of flip-flop 125 where the pulse count is divided by two and fed from pin 10 into pin 8 of gate 87 which is open allowing this divided signal to feed through gate 88, 101, 102 and into pin 4 producing a down count of two in the display counter circuit. Since a negative two occurred while a positive four was initially shown on the display 137 we would now show a reduction of two in the players score with a resultant total score of two.

The signal from gate 48 on a negative score sequence was carried to gates 86 and 87 but not described for gates 100 and 99. Note that the "0" signal from gate 48 creates a reversal of the previous output signals of gates 99 and 100. This reversal is relative to the condition that was established at these gates when a positive signal was initiated in the previous example. This change in signals from gates 99 and 100 produces a change in control gates 102 and 103 providing a downcount rather than an upcount entry on counter 134.

In the above description all steps have been followed for both positive and negative scores moving individually during travel through the control circuit. In the next example a two button selection by the player will be described with one number being selected from buttons 1 through 4 (type of play selected) and the second number being selected from button 5 through 7 (indicative of the results of that play whether there by a gain, loss, or no gain). It is important to note that, in the illustrated embodiment, if either of these two selections made by the player is incorrect and does not match the entries made on the controller board 212 then the player will receive a negative rather than a positive score. The negative score in all cases in this embodiment will be equal to the positive score that would have been received had the player been correct except that this score, when negative, will be divided by a factor of two. Other results could obviously be designed without departing from the scope of the invention. In this description there will be described the locking arrangement that creates the positive and negative signal according to the sequences on the panelling control board.

In this example the player selection will be button 216 and 224 (indicating a pass play and a gain). When button 240 is pressed the action that occurs is identical to that which occurred when the pushing of the same button in the first example.

When the output signal of gate 28 changes it creates a change in output of inverter 61. This signal P4 is entered at pin 7 of counter 130 creating such a condition in this counter that it will be enabled and become active on receipt of the pulse signal from generator 128 once the SCORE button has been pressed.

The player selection is now set by depressing buttons 216, 214, (indicating "PASS" and "GAIN"). The results actually obtained when this particular event occurs are recorded by the controller on the control board by depressing buttons 242, 248 (indicating "RUN" and "GAIN"). This means that the player's prediction was erroneous and as a result of this the player will now receive a negative score. This scoring is accomplished as follows.

Activation of the player's button 216 latches the "latch circuit" controlled by button 216 (gates 20,21) and changes the input signal on pin 12 of gate 29 as previously described. Since the control board button 240 is not depressed pin 13 of gate 29 is not changed and gate 29 is not opened. Subsequently the output of gate 33 remains unchanged and the input therefrom to gates 43 and 44 remains unchanged. These inputs lock gates 43 and 44 producing no change in output of gate 48. The gate 48 output remains at "0" which will produce a negative signal as previously described.

The output of gate 28 which changed when button 216 was pressed passes through gates 18, 19, and gates 3, 4, 5 and 6. This change in state of the output of gate 6 produces a "0" signal to one terminal of push buttons 224, 226, 228, through 7. This enables these buttons to be ready for activation and the player can now make his outcome selection by depressing button 224.

When this selection is made the latch circuit controlled by switch 224 (gates 8,9) locks the circuit producing the following results:

(a) Indicator lamp 121 is lighted;

(b) Gate 15 output changes state. The change in output of gate 15 passes through gate 5 and 6 creating a "1" state on 6 output locking the circuit and preventing selection of different or other switches 226, 228. The end output of gate 8 feeds into pin 1 of gate 40 creating a change which passes through gates 41,42 changing the P3 signal to a "0" state. This change in signal closes gates 49, 50, 51 and 52. Locking these gates keeps gates 73 and 75 closed thereby enabling scores larger than four or two to pass through the circuit.

Pressing button 216 on the player selection board changes the input signal to pin 13 on gate 54, pin 1 on gate 55, and pin 4 on gate 56. Pressing button 224 on the player board changes the input signal to pin 12 of gate 54, pin 9 of gate 57 and pin 9 of gate 59. The only gate which received changes in inputs from both push button switches 216 and 224 is gate 54. This dual change in input changes the output of gate 54 which when passed through gate 68 and inverter 69 enables gate 67 to transmit data information which it will receive from the #3 pin of driver 126 and from the #14 pin on flip-flop 125. This arrangement has now established a circuit route whereby a score of plus twelve will be registered if the player's selections are correct or a score of minus six will be registered if the player's selection is incorrect.

Pulse signals transmitted through pin 11 of driver 126 passes through inverter 82 into the input pin 1 of flip-flop 125. This count occurs on every count pulse passing through driver 126. When the input signal to pin 1 on flip-flop 125 changes, the state of the flip-flop in this circuit reverses. This change of state is indicated by the output signal of pin 14 on flip-flop 125 and registers as a "1" or "0". In this manner it either closes or opens the count gates numbered 64, 65 and 67 corresponding to a count of greater than 10.

The sequence of events for a dual entry is identical to that established earlier for the single player entry. The entry is made, the controller lock button 256 is pressed, the event occurs, and the type of event occurring and results of that event are entered on the player control board. Following this the SCORE button 258 is pressed.

At this point the player entry sequence, the lock sequence, and controller board entry sequence have been discussed. The remaining step is the scoring operation.

For this discussion assume the score indicated on the player board prior to pressing the score button 258 is plus two. Viewing the output number shown on gate 67 it is obvious that the positive pulse entry would be twelve. In our case, since the player wrongly predicted the type of event to occur, the score will be negative producing a twelve divided by two or a minus six. This is registered as follows. When the SCORE button 258 is pressed the sequence of operations of this dual selection event is identical to that which occurred for the single selection event described previously where the negative score was encountered. The only difference involved is that the signal to the number counter circuit is routed through gate 67 to produce a twelve pulse count rather than through gate 73 as was the previous case for a four pulse count. The negative factor becomes evident as before after the signal passes through gate 83. It is then routed through flip-flop 125 and through gate 87 and 88. This produces the divide by two condition and the data after being divided enters through gate 102 into counter 134 just as on the previous occasion. This standard data route holds position until the player board display 230 has reduced from a display of plus four to the zero/zero display on the two LED readouts 137, 138. When the double zero display occurs flip-flop 132 changes condition in the change in output on pins 12 and 13. This change lights the negative indicator lamp 234 and reverses the conditions of gate 102 and 103. The remaining pulses of data for this particular score signal will now be fed through gate 103 into pin 5 of counter 134 for an upcount. This sequence causes the following action on the display readout. The starting score was plus two. Sequence will be 2, 1, 0, 1, 2, 3, 4. The display counter circuit itself is actually showing a positive count but the lighting of the indicator lamp 139 indicates that the value of the score is now negative.

The changing condition of flip-flop 132 described above is created when the player score value is at zero. At zero condition all input signals to gates 106, 107 and 108 will be zero, producing a "1" output on these three gates. The score that is being entered at this time is a negative value. This produces a "1" signal state of the output of gate 98. Note now that all inputs to gate 109 are now at a "1" state. The output of gate 109 now goes to a "0" state closing gate 112 and through inverter 113 opening gate 114. Gate 114 in this condition can now transmit signals received from pin 4 of driver 131. Data can now be fed through gates 114, 115, 111, 110, 116 and gate 93. Gate 93 is enabled through pin 4 when the reset sequence occurs on the circuit. With gate 93 open the output signal of gate 116 feeds through gate 93, 94, and 96. The output of gate 96 goes to a "0⇄ state pulling pin 13 of flip-flop 132 to a "0" state through the diode. This action reverses the position of the flip-flop 132 controlling output pin 12, 13 initiating a negative state at the indicator lamp 234 while reversing the data entry point on counter 134 from a downcount entry to an upcount entry. The data count will continue and the data will enter the display counter circuit through the upcount mode through pin 5 of counter 134. When the proper data count has been measured through the number counter circuit the players score indicator will register a value of "4". The lighted lamp 234 indicates that this score is a negative number.

This concludes the entry of the score for this particular selection. It was purposely selected so that the score value would pass from a positive value through zero to a negative value. Two other conditions remain to be described.

Under the first condition the score indication changes from minus four value to a plus four value. The indication on the player board is presently "−4". The selection by the player was correct and he is to be rewarded with a plus eight score. In this case the indicated value on the player score is negative therefore the score entry will be normal as described in the earlier example except that due to the negative circuiting arrangement the score data will be entered into counter 134 through pin 4 (causing down count). This down count entry will continue until the player's score reaches a "00" value. This means that the indication on the player board would move from 4, 3, 2, 1, 0 as a down count operation in a negative mode. At this point the negative positive signal from gate 48 is feeding gates 99 and 100 to produce what would normally be an upcount to the display counter circuit. However, the inverted condition of the flip-flop serving pin 12 and 13 of flip-flop 132 due to the negative mode in which the system is operating reverses the gating sequence at gates 99 and 100 and beyond that point inverts the gating conditions to produce a downcount entry to the display counter circuit. This conditioning will hold, as stated above, until the indicated score on the players board reaches the value of 00.

The "1" signal input at pin 12 at gate 98 produces an input of "0" at pin 2 of gate 109 locking this gate to an output signal of "1". The output signal through gate 113 locks gate 114 while enabling gate 112 to receive the signal transmitted by pins 7 of driver 131. This signal is transmitted through gate 112, 115, 111, 110, 116, 93, 95 and 97 to pin 1 of flip-flop 132. On the negative transition of the output of gate 97 the output values of pins 12 and 13 of flip-flop 132 reverse their conditions extinguishing the negative indicator lamp 239 and reversing the position of gates 102 and 103 and changing the data entry into counter 134 from the downcount pin 4 to the upcount pin 5 thereof. The counting sequence continues and the player's score begins indicating 1, 2, 3, 4, where at this point the normal circuit counter stops the data input and ends the scoring signals. The score value is now at plus four.

The second condition to examine is that under which the player's score changes from a negative value to a 00 value. At this point it would be well to examine the latch circuit formed by gates 91 and 92. The normal positon of this circuit gives an output on the end output of the latch of "1" producing this same signal at pin 4 of gate 93, thus enabling gate 93 under this condition. This condition is established when the reset cycle is activated. The control of this latch is fed through gate 89. Gate 89 is in turn controlled by the output of the latch circuit formed by gates 79 and 80 and the signal received from pin 9 of driver 131. Gate 93 is thus enabled at all times following reset actuation until the number count latch consisting of gates 79 and 80 changes state and is followed by the next output signal from pin 9 of driver 131. At this time interval the latch circuit formed by gates 91 and 92 changes state thereby closing gate 93.

This function is to assure the entry of a single rather than possible multiple reset pulses to pin 1 at flip-flop 132. This assured entry of a single pulse assures that the circuit of flip-flop 132 will be in the proper position for the next scoring input sequence.

One remaining item on the circuit is the "100's" indicator lamp 232. Counter 134 is cascaded into counter 133 through the borrow/carry connections of pins 13 and 12 of the former into the down and up count inputs of the latter at pins 4 and 5. When the scoring sequence reaches a value of 99 and moves to 100, counter 133 changes the output of pin 12 to carry the signal through gate 105 into pin 5 of flip-flop 132, which produces a change in output of pin 9 of the flip-flop 132, in turn illuminating the "100's"indicator LED. When the score moves back to the 100 value downward the reverse process extinguishes this LED through the borrow connection feeding gate 105. The remaining function on the board is the CLEAR button. This button clears all IC's in the display counter circuit. This also results in extinguished negative indicator lamp 234, "100's" indicator lamp 232, and a "00" indication on the player's score indicator 230. The description and designation of each electrical component described hereinabove is set out in Table I below.

TABLE I

DESCRIPTION OF ELECTRICAL COMPONENTS

| ELEMENT NO. | NAME | TYPE |
|---|---|---|
| 1, 2, 8–14, 20–27, 29–32, 34–36, 38–40, 42–45, 49–52, 54–59, 62, 68, 72, 77, 79, 80, 83, 89, 91, 92, 93, 102, 103, 105, 111, 112, 114, 115 | 2 Input - NAND gate | 7400 |
| 3, 5, 17, 18, 46–48, 70, 73, 75, 78, 84, 86–88, 94, 95 | 2 Input - NOR gate | 7402 |
| 4, 6, 7, 16, 19, 61, 63, 69, 71, 74, 81, 82, 85, 90, 96, 97, 104, 113, 116, 180 | HEX INVERTER | 7404 |
| 15, 28, 33, 37, 109, 110 | 4 Input - NAND gate | 7420 |
| 41, 53, 60 | 3 Input - NAND gate | 7410 |
| 64–67, 76, 106–108 | 3 Input - NOR gate | 7427 |
| 98–101 | EXCLUSIVE - OR gate | 7486 |
| 117–124, 139 | INDICATOR LAMP (LED) | |
| 125 | FLIP/FLOP | 7476 |
| 126 | BCD/Decimal DECODER/ DRIVER | 74145 |
| 127, 130 | DECADE COUNTER | 7490 |
| 128 | PULSE GENERATOR | 74121 |

TABLE I-continued

| DESCRIPTION OF ELECTRICAL COMPONENTS | | |
|---|---|---|
| ELEMENT NO. | NAME | TYPE |
| 129 | TIMER | 555 |
| 131 | BCD/DECIMAL DECODER | 7442 |
| 132 | FLIP/FLOP | 7423 |
| 133, 134 | UP/DOWN COUNTER | 74192 |
| 135, 136 | DECODER/DRIVER | 7447 |
| 137, 138 | LED SINGLE DIGIT READOUT | |

SUMMARY

There is thus described hereinabove a unique game to be played in conjunction with the viewing or observing of an actual or simulated event on television, radio, in person or the like. The game may be played by several players, although FIG. 1 is descriptive of a setup for two players and a controller. The concept of the game is unique in that a player of the game tries to predict two aspects of a sequence of distinct types of occurrences going on in the event being viewed. For example the player, while watching football, tries to predict the type of play next occurring and the outcome. After the next play, a control board is programmed with the actual type of play and results and each player's own selector unit is adjusted to show his cumulative score as the game proceeds.

The embodiment described hereinabove is a relatively simple scoring system and can be made more complex. For example the amount of gains or losses might be predicted. Touchdowns or first downs might be predicted. The variations are numerous, however, it is believed the basic concept and approach is well described herein.

Although the game is described in connection with the viewing of a football game, and believed to be most adaptable for such type of event, other events having a sequence of individually separate events or occurrences, each of a predictably distinct type and having an outcome or result are possible. For example, the game might be adapted for use in connection with the viewing of TV quiz shows in which a participant selects categories, then answers questions in such categories.

Further, the electrical arrangement is descriptive of one workable embodiment, although the number of other electrical arrangements and logic circuits which would function satisfactorily are quite numerous. Various changes and modifications to the specific preferred embodiment described above being possible, then, the invention is to be limited in scope only the the following claims:

What is claimed is:

1. An electronic game playable by one or more participants in conjunction with the observance of a football game, said observance being in person, by watching television, or by listening to the radio, said game comprising:

(a) at least one prediction panel having at least two sets of switches thereon a first set of said sets having designations associated therewith corresponding to various types of plays which may occur in a football game, the second of said sets having designation associated therewith corresponding to various outcomes which may occur during said plays, and a score display means for maintaining a cumulative score record thereon;

(b) a control panel including a first set of result signal switches corresponding and electrically connected to the first set of switches on said prediction panel and a second set of signal switches corresponding and electrically connected to the second set of switches on said prediction panel for initiating the transmission of a control signal to said prediction panel indicative of the actual play occurring and the actual outcome thereof;

(c) an electrical circuit means associated with said prediction panel and said control panel for comparing prediction data from said prediction panel and outcome data from said control panel and adjusting said scoring display means responsive to the results from said comparison.

2. The electronic game according to claim 1 wherein said result signal switch means on said control panel includes at least two sets of switches thereon identical in number and designation to the switches on said prediction panel, whereby said control signal is initiated by depression of switches corresponding to the actual occurrence after the fact.

3. The electronic gam according to claim 1 wherein a plurality of prediction panels are connected to and controlled by a single control panel.

4. The electronic game according to claim 3 wherein said electrical circuit includes a locking circuit between said control panel and each of said prediction panels, whereby the predictions on said prediction panels may be locked and unchangeable at a selected time from said control panel.

5. The electronic game according to claim 1 wherein said first set of switches is four in number with the associated designations being "PASS", "RUN", "PUNT", "FIELD GOAL", and the second set of switches are three in number with the associated designations being "GAIN", "NO GAIN", and "LOSS".

6. The electronic game according to claim 1 wherein said electrical circuit comprises:

(i) prediction data transmitting portion for receiving and transmitting electrical data responsive to activation of said first and second sets of switches on said prediction panel to enter participant predictions into said circuit;

(ii) outcome data transmitting portion for receiving and transmitting data responsive to activation of said result signal switch means on said control panel to enter into the circit results of the type of plays and outcome thereof actually occurring;

(iii) data comparing portion for determining whether data from said prediction data transmitting section is accurate or not; and (iv) calculating portion for changing said cumulative score record on said score display means responsive to results from said data comparing portion.

7. The electronic game according to claim 6 wherein said prediction data transmitting portion includes a first set of latch circuits corresponding to and connecting each of said switches in said first and second sets of switches on said prediction panel to a set of corresponding gates and providing one of the inputs thereto, and said outcome data transmitting portion includes another set of latch circuits corresponding to and connecting each of said control switches to the same corresponding gates as the second input thereto, whereby said data comparing portion is activated by either a matching or non-matching of signals at said gates.

8. The electronic game according to claim 1 wherein said first set of switches on said prediction panel are selectively useable by a player exclusive of an attendant use of said second set of switches wherein such case said electrical circuit means automatically causes attendant pro-rated scoring adjustments.

9. An electronic game playable in conjunction with the observance of a simultaneously occurring program not involving the participants which program involves a sequence of individually occurring events, each of which events is of a predictably distinct type and includes an attendant result, said game comprising:

(a) a plurality of prediction panels having a plurality of first switches corresponding in number to at least some of the possible anticipated distinct types, a plurality of second switches corresponding to a plurality of possible results of each event and a scoring means for maintaining a cumulative record of the scoring on each of said prediction panels;

(b) a control panel including a first set of result signal switches corresponding and electrically connected to the first set of switches on each of said prediction panels and a second set of signal switches corresponding and electrically connected to the second set of switches on each of said prediction panels for transmitting a signal to each of said prediction panels indicative of the actual outcome of each event as far as the actual type attempted and the actual results thereof;

(c) an electrical circuit associated with said scoring means on each prediction panel, said electrical circuit further including a calculating portion for causing changes in said scoring means responsive to signals from said control panel compared with predications on said prediction panels;

(d) whereby a participant selects on one of the prediction panels the predicted distinct type of the next event and the predicted results, a person designated as controller activates the control panel to signal the actual distinct type of the event which next occurs and the results after the event, and the prediction panel receives the signal back and automatically adjusts the score responsive to the predictions made and actual outcome of the event.

10. The electronic game according to claim 9 wherein said result signal switch means on said control panel includes at least two sets of switches thereon identical in number and designation to the switches on said prediction panel, whereby said control signal is initiated by depression of switches corresponding to the actual occurrence after the fact.

11. The electronic game according to claim 9 wherein said electrical circuit includes a locking circuit between said control panel and each of said prediction panels, whereby the predictions on said prediction panels may be locked and unchangeable at a selected time from said control panel.

12. The electronic game according to claim 9 wherein said electrical circuit comprises:

(i) prediction data transmitting portion for receiving and transmitting electronical data responsive to activation of said first and second sets of switches on said prediction panels to enter participant predictions into said circuit;

(ii) outcome data transmitting portion for receiving and transmitting data responsive to activation of said result signal switch means on said control panel to enter into the circuit results of the type of plays and outcomes thereof actually occurring;

(iii) data comprising portion for determining whether data from said prediction data trasmitting section is accurate or not; and (iv) calculating portion for changing said cumulative score record on said score display means responsive to results from said data comparing portion.

13. The electronic game according to claim 12 wherein said prediction data transmitting portion including a first set of latch circuits corresponding to and connecting each of said switches in said first and second sets of switches on said prediction panel to a set of corresponding gates and providing one of the inputs thereto, and said outcome data transmitting portion includes another set of latch circuits corresponding to and connecting each of said control switches to the same corresponding gate as the second input thereto, whereby said data comparing portion is activated by either a matching or non-matching of signals at said gates.

14. The electronic game according to claim 4 wherein said first set of switches on said prediction panel are selectively useable by a player exclusive of an attendant use of said second set of switches wherein such case said electrical circuit means automatically causes attendant prorated scoring adjustments.

* * * * *